United States Patent [19]

Harpold

[11] 4,381,706

[45] May 3, 1983

[54] PRINTING SCREEN AND METHOD

[76] Inventor: Charles W. Harpold, 405 Douglas, NW., Grand Rapids, Mich. 49504

[21] Appl. No.: 245,046

[22] Filed: Mar. 18, 1981

[51] Int. Cl.[3] ..... B05C 17/06; B05C 17/08

[52] U.S. Cl. ..... 101/127.1

[58] Field of Search ..... 101/127.1-128.4, 101/114, 127, 35 -38 R

[56] References Cited

U.S. PATENT DOCUMENTS

| | | | |
|---|---|---|---|
| 2,014,372 | 9/1935 | Brickett, Jr. | 101/114 |
| 2,014,373 | 9/1935 | Brickell, Jr. | 101/126 |
| 2,018,989 | 10/1935 | Wulf | 101/126 |
| 2,057,788 | 10/1936 | Pannier, Jr. et al. | 101/127.1 |
| 2,067,949 | 1/1937 | Rez | 65/60.8 |
| 2,105,378 | 1/1938 | Smith | 200/76 |
| 2,227,325 | 12/1940 | Shapiro | 101/128.1 |
| 2,239,619 | 4/1941 | Mergatroyd et al. | 101/115 |
| 2,347,022 | 4/1944 | Austin | 101/129 |
| 2,818,803 | 1/1958 | Levorson | 101/127.1 |
| 3,102,469 | 9/1963 | Sherman | 101/122 |
| 3,167,004 | 1/1965 | Miller | 101/127.1 |
| 3,334,003 | 8/1967 | Edwards | 101/128.4 X |
| 3,372,639 | 3/1968 | Edwards | 430/308 |
| 3,414,994 | 12/1968 | Jaccard | 101/127.1 X |
| 3,427,964 | 2/1969 | Vasilantone | 101/115 |
| 3,482,300 | 12/1969 | Reinke | 29/160 |
| 3,783,777 | 1/1974 | Killen et al. | 101/40 |
| 3,872,614 | 3/1975 | Seitz | 40/158 R X |
| 4,058,215 | 11/1977 | Marchbank | 40/158 R X |
| 4,084,504 | 4/1978 | Fuchs | 101/115 |

OTHER PUBLICATIONS

"The Alpha Cap Printer", Famco Cap Printing Systems, McCaysville, Georgia, Jan. 1, 1980.

*Primary Examiner*—A. J. Heinz

*Attorney, Agent, or Firm*—Price, Heneveld, Huizenga & Cooper

[57] ABSTRACT

A screen for printing curved surfaces comprises a frame having a substantially rigid end segments, and resilient, semi-rigid side segments, which are flexed traversed to the plane of the frame into an arcuate configuration for printing. During assembly of the printing screen, the frame side segments are deflected laterally inwardly a predetermined distance, and temporarily retained in the deflected condition by an assembly jig. A panel of screen fabric is mounted taut in a tensing frame, and positioned overlying the screen frame in the assembly jig. The screen fabric is attached to the perimeter of the screen frame, and the assembled printing screen is cut from the remainder of the screen fabric. The printing screen is then removed from the assembly jig, thereby releasing the frame side segments, and applying additional lateral stress to the screen panel. When the assembled printing screen is flexed into the desired arcuate configuration, the lateral stress in the screen help to retain the pattern in its true, undistorted shape.

19 Claims, 11 Drawing Figures

PRINTING SCREEN AND METHOD

BACKGROUND OF THE INVENTION

The present invention relates to screen printing, and in particular to a novel printing screen, kit and method for accurately printing curved surfaces.

Screen printers for articles having arcuately shaped surfaces, such as food containers, barrels, drinking glasses, bottles, hats, and the like, are well known, and generally include a curved printing screen which mates with the rounded configuration of the object to be printed.

Heretofore, it has been extremely difficult and expensive to fabricate such a curved printing screen without distorting the pattern. For instance, one method for fabricating arcuate printing screens is illustrated in U.S. Pat. No. 2,347,022, and comprises forming the pattern on a flat sheet of screen fabric, and then adhering the screen to a flexible frame. However, when the frame is bent into the desired configuration, the screen is tensed unevenly, and tends to bow or cup at the center. This non-uniform stretching distorts the printing pattern from its true shape, so that the images printed are not properly proportioned. Further, the bowed printing screen prevents the screen from abutting flat against the article, and thereby causes smearing so that the images printed are not clean and clear. The inaccuracies inherent in such printing screens are particularly pronounced in multi-colored printing, as it is virtually impossible to properly register the distorted patterns. Also, if a flat squeegee is used on such screens, the ink is not uniformly applied to the article.

Another screen assembly method designed to overcome such difficulties, comprises mounting a panel of screen fabric in a pre-formed, arcuately shaped frame which fits the curved article. The screen fabric is treated for photosensitivity, and a film positive is taped to the front side of the screen. The screen is positioned on a clear plastic or glass mandrel having the same contour as the screen, and is held in place by clamps or weights. Ultraviolet light is beamed through the mandrel causing the screen to become exposed, and transferring the printing pattern thereonto. In such processes, the ultraviolet light is dispersed as it passes through the mandrel, thereby causing distortion in the transferred printing pattern. Further, this method is quite expensive, complex, and requires sophisticated equipment, so that it is not adapted to make screens for specialty, low volume printing applications, such as hats, or the like. Since specialty screen printing in small shops and stands has become very popular as of late, there is an increasing demand for a high quality, arcuate printing screen which can be fabricated quickly, easily, and inexpensively.

Yet another method for fabricating screens to print arcuate objects comprises forming the printing pattern on a flat panel of screen fabric, and then hand stretching the screen onto a pre-formed, curved frame. Although this technique is rather simple, the screen material cannot be uniformly tensed by hand, thereby causing distortion in the printing pattern. Also, it is virtually impossible to mount mating portions of a multi-color design in a manner that will assure proper registry.

SUMMARY OF THE INVENTION

One aspect of the present invention is a method for making screens to accurately print on curved surfaces of articles, and the like. The method comprises providing a frame having substantially rigid end segments, and resilient, semi-rigid side segments connected therewith to define a frame perimeter. The frame is adapted to be flexed along the side segments in a direction generally transverse to the plane of the frame into an arcuate configuration which is complementary with the shape of the article to be printed. The frame side segments are deflected laterally inwardly a predetermined distance, and temporarily retained in the deflected condition. A panel of screen material is tensed into a generally, uniformly taut condition and positioned overlying the frame. The taut screen panel is then attached to the perimeter of the frame, with the frame side segments in the inwardly deflected condition. The frame side segments are then released, thereby laterally stressing the screen panel, whereby when the screen is flexed into the desired arcuate configuration for printing, the lateral stressing alleviates cupping in the screen and distortion of the printing pattern.

Another aspect of the present invention is a printing screen comprising a flexible frame adapted to be bent into an arcuate configuration which mates with the surface to be printed. A sheet of elastic screen material is attached to the perimeter of the frame in a generally flat condition. The screen is mounted tautly in the frame, and stressed laterally between the frame side segments an amount greater than between the frame end segments. When the assembled screen is flexed into the curved position, the lateral stressing in the screen fabric alleviates distortion of the printing pattern, and tends to retain the screen panel in a flat condition.

Yet another aspect of the present invention is a kit for making screens to print arcuate articles, comprising a frame, a panel of screen material, and an assembly jig shaped to receive the frame therein, and retain the resilient side frame segments of the frame in the inwardly deflected condition during attachment of the printing screen. The kit also includes a tensing frame, having a perimeter larger than the perimeter of the printing frame, which holds the screen fabric taut during attachment to the frame. The kit may include a rigid screen holder, having end plates which detachably anchor the ends of the printing frame in a mutually inclined orientation to bend the frame into the desired configuration.

Yet another aspect of the present invention is to provide an assembly jig for making printing screens of the type having a frame with substantially rigid end segments and resilient side segments, and a screen panel mounted therein. The assembly jig includes a base, with a pair of stops upstanding from a medial portion of the base. The stops are substantially rigid, and spaced apart a distance slightly less than the spacing between the outer edges of the frame side segments, whereby the frame side segments are deflected inwardly when the frame is inserted into the jig. Means, such as ribs or serrations on the interior sides of the stops are provided to securely retain the frame in place.

The principal objects of the present invention are to provide a screen printing arrangement capable of accurately and precisely printing onto curved surfaces and objects. The printing arrangement laterally stresses the printing screen fabric in a manner such that when the screen is flexed into its operational position, it presents a relatively flat surface against the object to be printed, and the printing pattern is substantially free from distortion. The printing arrangement is therefore capable of producing clean, neat images without smearing. The lateral stress placed in the screen fabric is accurately controlled by an assembly jig, so that the various patterns of a multi-color design can be easily registered. The printing arrangement is relatively inexpensive, uncomplicated, and easy to use and manufacture, such that it is particularly adapted to small, portable screen printers for specialty, low volume applications.

These and other features, advantages, and objects of the present invention will be further understood and appreciated by those skilled in the art by reference to the following written specification, claims, and appended drawings.

DETAILED DESCRIPTION OF THE PREFERRED EMBODIMENTS

Figure 1:
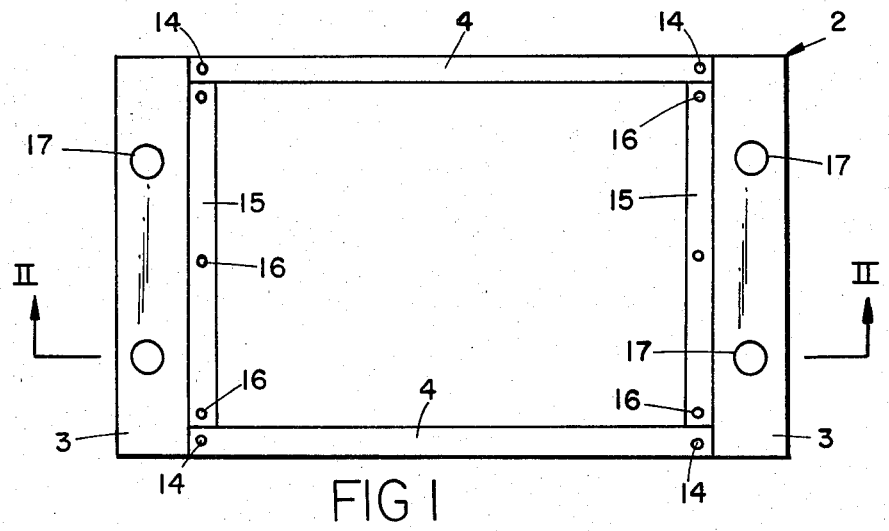
FIG. 1 is a top plan view of a frame portion of a printing screen embodying the present invention.

For purposes of description herein, the terms "upper", "lower", "right", "left", "rear", "front", "vertical", "horizontal", and derivatives thereof shall relate to the invention as oriented in FIG. 1. However, it must be understood that the invention may assume various alternative orientations, and step sequences, except where expressly specified to the contrary.

Figure 2:
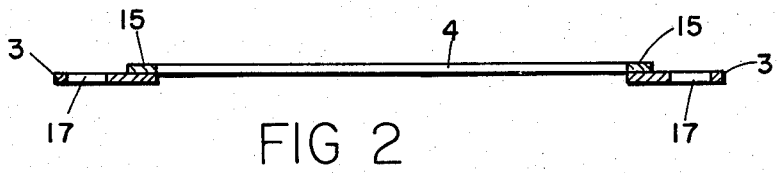
FIG. 2 is a vertical cross-sectional view of the printing frame, taken along the line II—II, FIG. 1.
Figure 3:
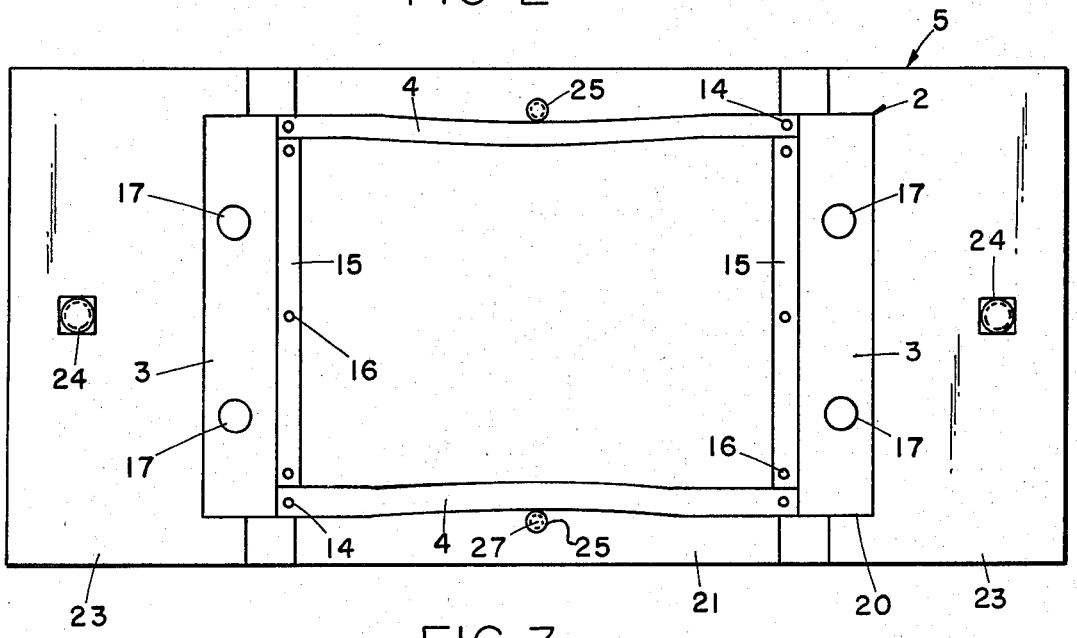
FIG. 3 is a top plan view of the printing frame, shown mounted in an assembly jig.
Figure 7:
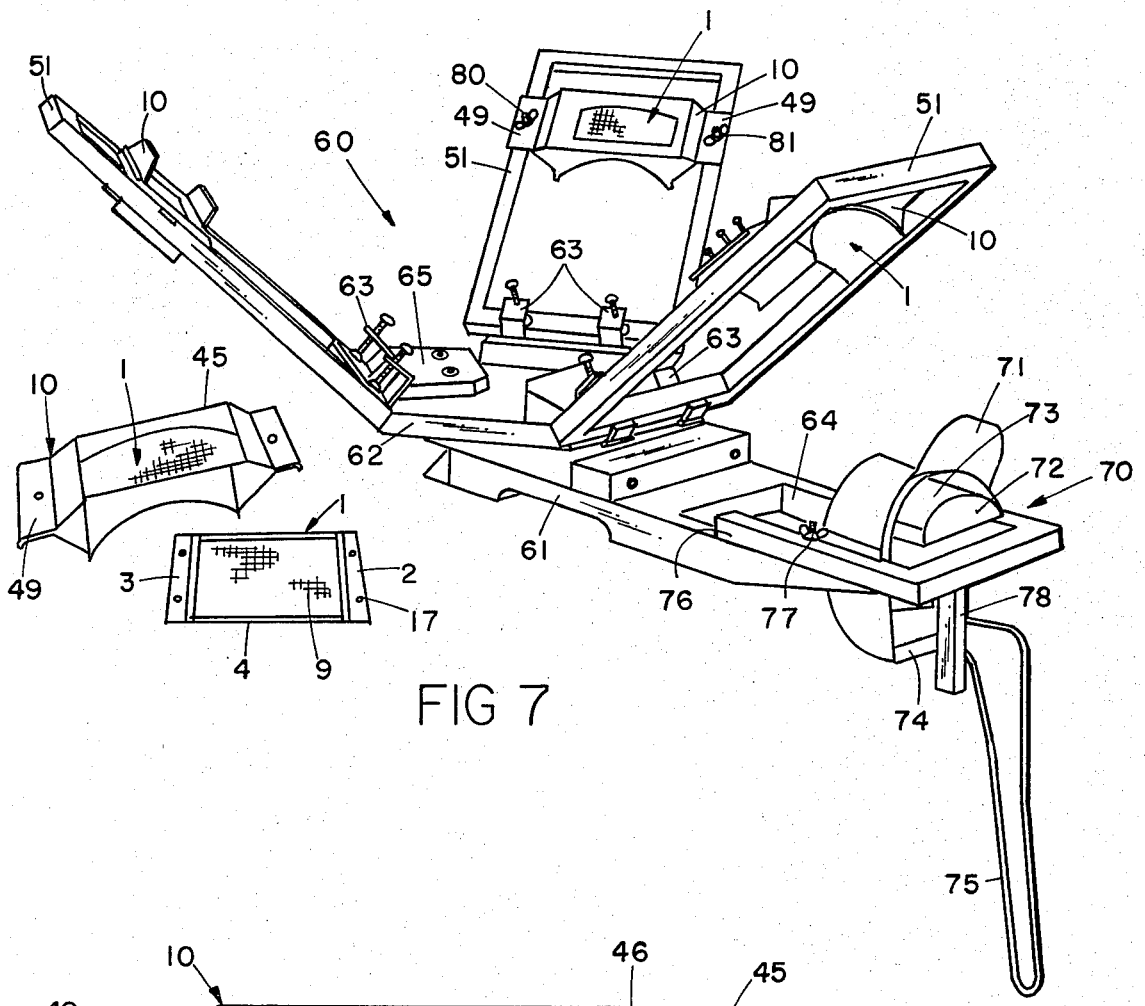
FIG. 7 is a perspective view of a multi-color, manual screen printer, with three printing screens mounted therein.
Figure 8:
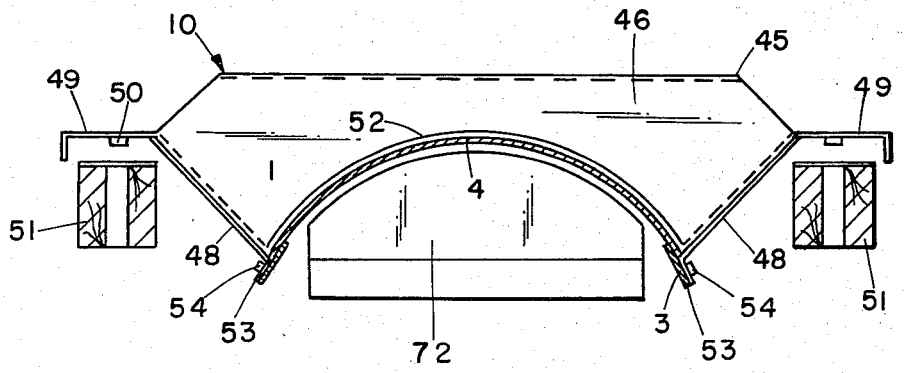
FIG. 8 is a side elevational view of the printing screen, shown mounted in a holder.

The reference numeral 1 (FIG. 7) generally designates a screen for printing arcuately shaped surfaces and articles, such as bottles, cans, hats, and the like. Printing screen 1 comprises a frame 2 (FIGS. 1–4) having substantially rigid end segments 3 and resilient, semi-rigid side segments 4. Frame 2 is adapted to be flexed along side segments 4 in a direction generally transverse to the plane of frame 2 into an arcuate configuration for printing. During the assembly of printing screen 1, frame 2 is mounted in an assembly jig 5, which laterally deflects frame side segments 4 inwardly, and temporarily retains the same in the deflected condition, as shown in FIG. 3. A sheet of printing screen material 6 (FIGS. 5–6), adapted to form a printing pattern 7 thereon, is mounted taut in a tensing frame 8, and positioned overlying screen frame 2 in assembly jig 5. Screen material 6 is attached to the perimeter of screen frame 2, by means such as adhesive or the like, and screen fabric 6 is then cut around frame 2 and separated from jig 5. A panel 9 of screen fabric is thereby mounted taut in frame 2. Printing screen 1 is then removed from assembly jig 5, thereby releasing frame side segments 4, and resiliently applying additional lateral stress to screen panel 9. Printing screen 1 is flexed into the desired arcuate configuration, and mounted in a holder 10, as shown in FIG. 8. The lateral stress placed in screen panel 9 alleviates screen cupping and distortion of the printing pattern when the screen is flexed for printing.

Screen frame 2 (FIGS. 1–4) is adapted to be flexed along side segments 4 into a substantially arcuate configuration to mate with the surface to be printed. In this example, frame 2 has a substantially rectangular top plan configuration, with side segments 4 in the nature of leaf springs. Side segments 4 have a substantially rectangular transverse cross-sectional shape, and are constructed of band-like segments of spring steel. The ends of frame side segments 4 are fixedly attached to frame end segments 3 by suitable means, such as spot welds 14. Transverse band segments 15, having a thickness commensurate with that of side segments 4, extend transversly between the ends of side segments 4, and are fixedly attached to the upper surface of end segments 3 by spot welds 16, so as to form a smooth, rectangular peripheral surface to which screen fabric 6 can be attached. Each end segment 3 includes a pair of apertures 16, shaped to receive fasteners therethrough to attach printing screen 1 to holder 10 in a manner described in greater detail hereinafter.

The screen frame end segments 3 are substantially rigid, and maintain the rectangular shape of the frame. Frame side segments 4 not only flex in a direction transverse to the plane of the frame so as to achieve the desired arcuate configuration but also flex slightly laterally, as shown in FIG. 2, and described below. In the illustrated example, frame side segments 4 have dimensions in the nature of $6\frac{3}{4}$ inch free length, $\frac{1}{4}$ inch width and 0.030–0.035 inch thickness. The distance between the outer edges of side segments 4 is approximately 4 inches. The illustrated end segments 3 have a thickness in the nature of 14 gauge, and a width of approximately $\frac{3}{4}$ inches.

Figure 4:
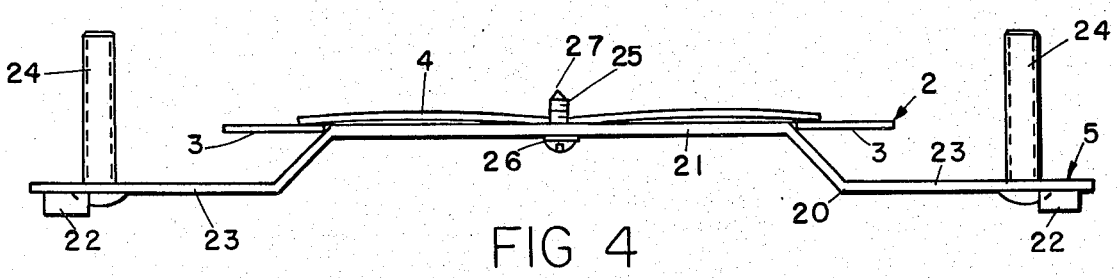
FIG. 4 is a side elevational view of the printing frame and mounting jig shown in FIG. 3.

Assembly jig 5 is illustrated in FIGS. 3–6, and includes a base 20 having a trapezoidally shaped vertical cross-section, with a raised support surface 21 shaped to receive screen frame 2 thereon. Jig base 20 includes soft rubber feet 22 attached to the bottom surface of flanges 23 to securely and safely support the jig on a surface without scratching or otherwise damaging the same. A pair of carriage bolts 24 are mounted in an aligned relationship in flanges 24, and extend upwardly from a medial portion thereof above support surface 21. The length of support surface 21 is preferably substantially commensurate with the length of screen frame 2. A pair of stops or studs 25 are mounted along the center portion of support surface 21, and extend upwardly therefrom a distance greater than the thickness of frame side segments 4. Studs 25 are spaced laterally apart a predetermined distance, such that the measure between the innermost surfaces of studs 25 is slightly less than the spacing between the outer edges of frame side edges 4. In this example, the difference in spacing is approximately 1/16 -$\frac{1}{8}$ inches. As best illustrated in FIG. 4, studs 26 include means such as ribs or serrations on the exterior surface thereof to securely retain screen frame 2 in place. The illustrated studs 25 have relatively fine threads, and are securely mounted in support surface 21 by a threaded connection therewith, and include a lock washer 26. Preferably, the free ends or tips 27 of studs 25 are sharpened or pointed for purposes to be described in greater detail hereinafter.

The screen material 6 is a conventional elastic fabric such as silk, nylon, etc. that can be stretched taut over frame 2. Preferably, the screen material 6 comprises a woven polyester or the like, with the panel sections cut in a manner so that the strands extend perpendicularly between the end and side segments of the frame, with the direction of maximum elasticity oriented accordingly. A 200–300 line screen mesh is preferred, however other fabrics can be used.

Figure 5:
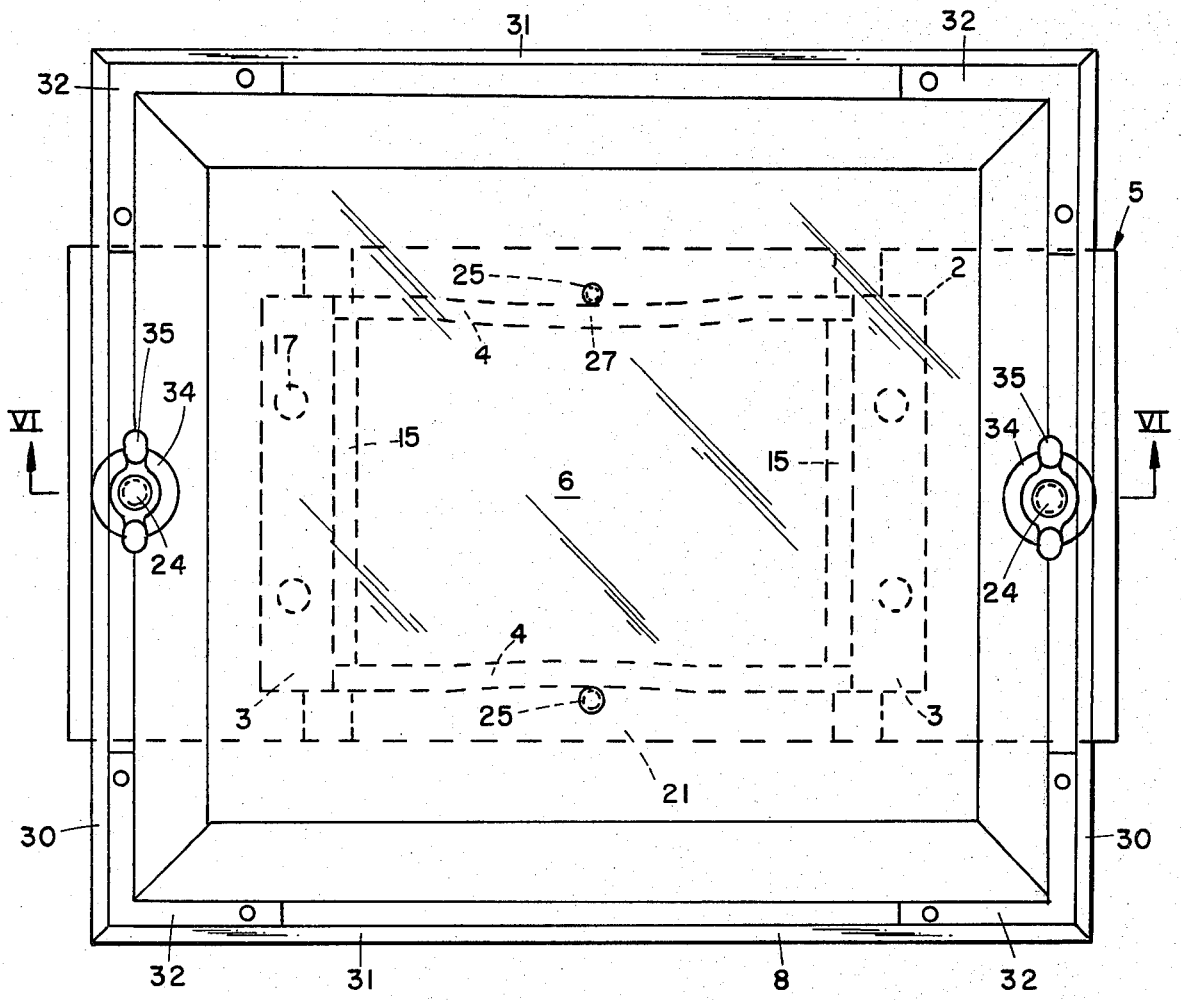
FIG. 5 is a top plan view of the assembly jig, with a tensioning frame mounted therein.
Figure 6:
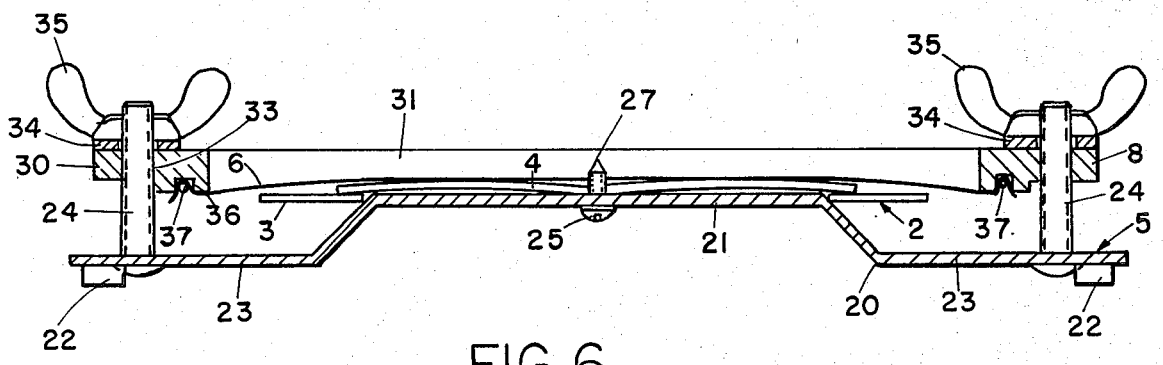
FIG. 6 is a vertical cross-sectional view of the assembly jig, taken along the line VI—VI, FIG. 5.

Tensing frame 8 has a generally conventional construction, comprising end and side segments 30 and 31 respectively, which are interconnected by corner keys 32 to form a generally rectangular construction with mitered corners. The end segments 30 of tensing frame 8 include apertures 33 therethrough in which carriage bolts 24 are received. Washers 34 and wing nuts 35 are attached to the free ends of carriage bolts 24, and are tightened thereon to press tensing frame 8 and screen material 6 abuttingly against the upper surface of screen frame 2. The lower surface of both the end and side segments 30 and 31 of tensing frame 8 include a channel 36 which extends continuously along the interior perimeter of the tensing frame, and is shaped to receive the outer edge of the screen fabric 6 therein. A retaining cord 37 is inserted into channel 36 between the folds of screen fabric 6, and securely retains the screen fabric in a taut condition. The interior perimeter of tensing frame 8 is larger than the exterior perimeter of printing screen 1, such that screen fabric 6 totally covers the mating surface of the screen frame 2, as shown in FIGS. 5 and 6.

A printing screen 1 is preferably fabricated in the following fashion. Screen frame 1 is inserted into assembly jig 5 with spring steel segments 4 and 15 oriented upwardly. The screen frame 2 is inserted into jig 5 by holding frame 2 at a slight inclination downwardly toward jig 5, and positioning the lower side segment 4 against the base of the adjacent stud 25. Screen frame 2 is then rotated downwardly until the opposite side segment 4 of frame 2 abuts the corresponding stud 25. The operator then pushes downwardly on the raised side segment 4 forcing it over the threads on the corresponding stud, until it engages the base of the stud, so that frame 2 is disposed adjacent the support surface 21 of the jig. Since the studs 25 are spaced apart slightly closer than the outer edges of frame side segments 4, the above described insertion of screen frame 2 into assembly jig 5 deflects or deforms side segments 4 laterally inwardly with a camming type of action. A sheet of screen fabric 6 is then tensed substantially uniformly over the lower side of tensing frame 8, and is mounted therein in a taut condition by insertion of cord 37.

Tension frame 8 is then positioned over assembly jig 5. Tensing frame 8 is converged with jig 5, with carriage bolts 24 being received through mating apertures 33, until the screen 6 overlies the upwardly oriented surface of screen frame 2 and is in abutment therewith. As tensing frame 8 is converged with screen frame 2, the pointed tips 27 of studs 25 abut the screen fabric 6, and pierce holes therethrough at two locations outside the outer perimeter of screen frame 2, and thereby permit the screen fabric to descend into an abutting relationship overlying frame 2. Washers 34 and wing nuts 35 are then fastened to the free ends of bolts 24, and are tightened until screen material 6 is stretched tightly and uniformly over frame 2. Screen fabric 6 is then fastened to the upwardly oriented surface of frame 2 by means such as a solvent resistant adhesive or the like. Adhesive may be applied to the abutting surfaces of frame 2 and/or screen material 6 either before or after the two members are assembled.

The assembled printing screen 1 is then removed from the assembly jig by first severing the unused portion of screen material 6 by cutting between the perimeters of frame 2 and tensing frame 8. Wing nuts 35 are then loosened, and tensing frame 8 is removed from assembly jig 5. The assembled printing screen 1 is then removed from jig 5 by lifting one side segment 4 of frame 2 upwardly while compressing the same inwardly over the serrations on stud 25, in a manner substantially opposite to that used for inserting frame 2 into the jig. As frame side segments 4 are released, they spring outwardly, thereby laterally stressing screen panel 9, particularly at the medial portion of the screen. This stressing slightly stretches the screen fabric in that direction.

Printing pattern 7 can be applied to or formed on screen panel 9 by virtually any conventional means, either before or after the screen fabric is mounted in frame 2. Preferably, pattern 7 is formed when the fabric is in a flat condition, such as after printing screen 1 has been assembled, but before flexing and mounting in screen holder 10. When printing screen 1 is flexed into the desired configuration, the lateral stress in screen panel 9 alleviates distortion of printing pattern 7. In other words, since the flexing of printing screen 1 causes the center of the fabric to bow or cup, and thereby distort printing pattern 7 and render it difficult to print neat images, the present invention provides additional lateral stress to screen panel 9 in the flat condition. As a result, when the screen is flexed, printing pattern 7 is not distorted, and the printing face will lie substantially flat against the object to be printed.

Figure 9:
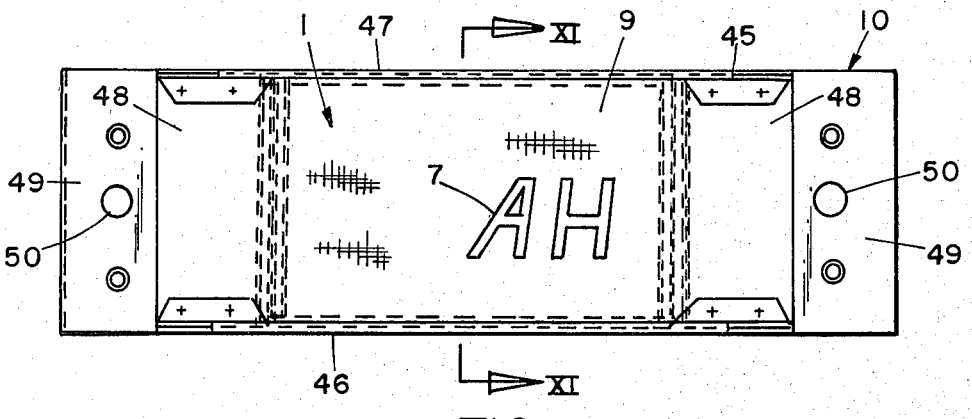
FIG. 9 is a top plan view of the screen holder.

Screen holder 10 is adapted to retain printing screen 1 in the desired arcuate configuration and form a reservoir to retain the ink. As best illustrated in FIGS. 7–9, holder 10 comprises a hollow housing 45 having front and rear walls 46 and 47 respectively interconnected in a spaced apart relationship by inclined end walls 48. L-shaped flanges 49 extend laterally outwardly from the sides of housing 45, and include apertures 50 therethrough for attaching housing 45 to the sides of a rectangular extension frame 51, as discussed below. The lower edges of front and rear walls 46 and 47 are free and arcuately shaped to define a cavity across which printing screen 1 extends. The end panels 48 of housing 45 have outwardly turned flanges 53 which are oriented at an angle with respect to each other, and retain printing screen 1 in the required arcuate shape. Preferably, screen 1 is mounted in holder 10 with the fabric side up, or closest to the holder. Flanges 53 include means for attaching the end segments 3 of printing screen thereto, and this example includes apertures through which fasteners 54 are received. When screen 1 is mounted in holder 10, the arcuate housing edges 52 do not abut any portion of printing screen 1, but rather are spaced slightly from it so that printing screen 1 extends unsupported between frame end segments 3 and can flex slightly to conform to the precise shape of the cap.

The illustrated screen holder 10 is particularly adapted for use in a manual printer, such as the mechanism illustrated in FIG. 7, and noted by the reference numeral 60. Printer 60 is similar to the device illustrated and described in my copending United States Patent Application Ser. No. 80,450, filed Oct. 1, 1979, and entitled SCREEN PRINTING MACHINE, which is hereby incorporated by reference. Printer 60 includes a stationary base 61, with a three screen printing head 62 rotatably attached thereto in a carrousel fashion. A pair of clamps 63 are pivotally mounted on each side of printing head 62 in a spaced apart fashion, and are adapted to attach a standard frame 51 thereto, such as those used for printing T-shirts and other flat articles. A counter weight arrangement 65 normally retains screens 51 in a raised position, and the screens are manually pivoted downwardly over the platen area 64 of base 61 to print.

A hat mounting assembly 70 is attached to the end of base 61, and is shaped to retain hats 71 in an upwardly directed orientation in the printer. In this example, mounting assembly 70 comprises cap platen 72 having a curved surface 73 which mates with the interior side of hat 71, and is stationary with respect to printer base 61. A counter weight 74 is pivotally mounted on an adjustment bar 78, when the counter weight is rotated, the rearward end of the counter weight converges and diverges with respect to cap platen 72. The lower surface of counter weight 74 engages the rear surface of cap 71 and pulls the cap downwardly over platen 71. A knee lever 75 pivots counter weight 74 so that the operator can insert and withdraw the caps 71. When pressure is released from knee lever 75, counter weight 74 automatically diverges from cap platen 72, and stretches the cap securely over platen 22. The entire mounting mechanism 70 is attached to printer base 61 by a U-shaped frame 76, which can be adjusted by manipulating fasteners 77.

Figure 10:
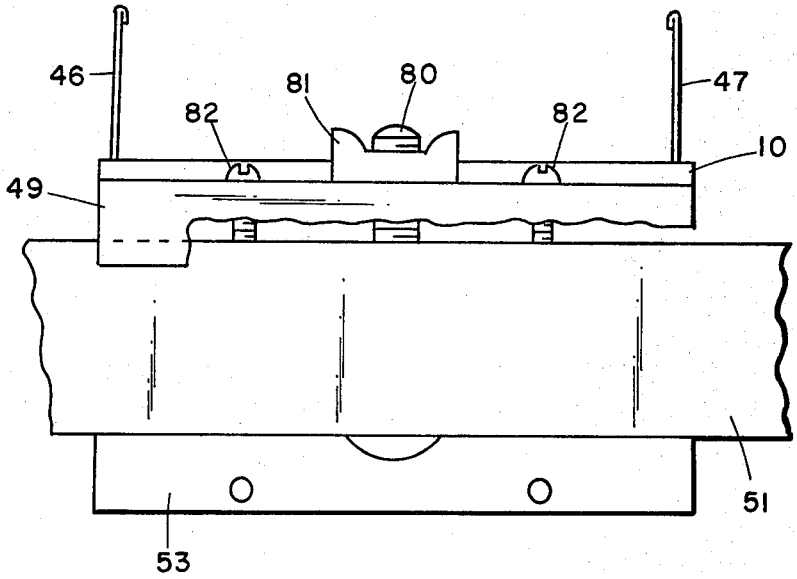
FIG. 10 is a side elevational view of the screen holder, shown attached to a fragmentary portion of a wooden extension frame.

As best illustrated in FIG. 10, screen holders 10 are adjustably attached to frames 51 by a carriage bolt 80 and nut 81. A pair of screws 82 extend downwardly through flanges 49 into abutment with the upper surface of frame 51, and provide means for easily adjusting the height of the printing screen with respect to cap platen 72.

Figure 11:
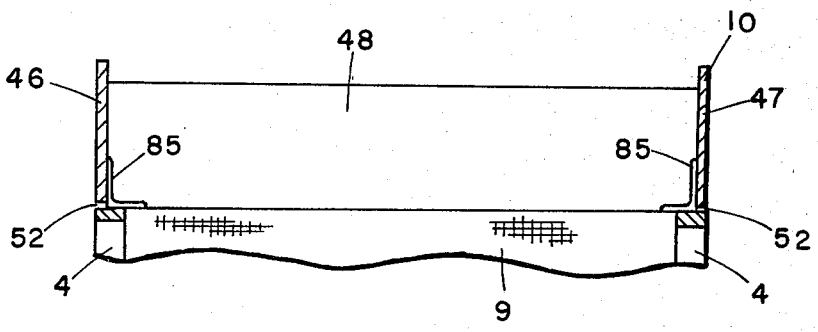
FIG. 11 is a vertical cross-sectional view of the printing screen and holder, taken along the line XI—XI, FIG. 9.

In operation, each of the printing screens 1 to be used is mounted in a holder 10, and attached to a different frame 51. Preferably, strips of tape 85 (FIG. 11) are applied around the inside of the screen, particularly over the gap formed between screen 1 and holder edges 52 to prevent the ink from leaking out of the reservoir. Hat retainer assembly 70 is positioned so that it is beneath screen 1 when frame 51 is swung downwardly. If more than one printing screen 1 is being used, the screens are registered by sequentially positioning the screens over cap platen 72, and adjusting holders 10. Ink is placed in each holder 10, and a flat squeegee or other suitable means can be used during printing.

The present printing arrangement provides accurate and precise screen printing for curved surfaces. The screen 1 is inexpensive, uncomplicated, and easy to fabricate. The assembly jig 5 precisely stresses the screens to alleviate smearing and pattern distortion, and improve registry between the patterns in multi-color designs.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows.

1. A method for making screens to print arcuately shaped articles and the like, comprising the steps of:

providing a printing frame having substantially rigid end segments, and resilient, semi-rigid side segments connected therewith to define a plane with a frame perimeter; said frame being adapted to be flexed along said frame side segments in a direction generally transverse to the plane of said frame into an arcuate configuration which is complementary with the shape of the article to be printed;

deflecting said frame side segments at medial portions thereof laterally toward each other a predetermined distance, and temporarily retaining the same in the deflected condition;

providing a panel of screen material shaped for attachment to the perimeter of said frame, and adapted for carrying a pattern to print onto the article;

tensing said screen panel into a generally, uniformly taut condition;

attaching the taut screen panel to the perimeter of said frame, with said frame side segments in the laterally deflected condition, and said frame positioned in a substantially flat condition;

releasing said frame side segments, thereby laterally stressing said screen panel;

forming a pattern on the lateral stressed screen panel with said screen panel in a substantially flat condition; and flexing said screen in a direction generally transverse to the plane of said frame into an arcuate configuration which is complementary with the shape of the article to be printed, whereby when said screen is flexed into the desired arcuate configuration for printing, said pattern is not distorted.

2. A method as set forth in claim 1, wherein: said frame side segments have outer edges spaced apart a predetermined distance; and said deflecting step comprises:

providing an assembly jig shaped to receive said frame thereon, and having a pair of upstanding studs spaced laterally apart a distance slightly less than the distance between the outer edges of said frame side segments; and inserting the side segments of said frame between said studs, thereby deflecting said frame side segments inwardly, and temporarily retaining said frame side segments in the deflected condition during said screen attaching step.

3. A method as set forth in claim 1, wherein said screen tensing step comprises:

providing a tensing frame having a perimeter larger than the perimeter of said printing frame, and means for retaining said screen panel therein;

mounting said screen panel in a uniformly taut condition in said tensing frame; and assembling said tensing frame with taut screen panel therein over said printing frame in the deflected condition.

4. A method as set forth in claim 1, wherein: said frame side segments have outer edges spaced apart a predetermined distance; and said deflecting step comprises:

providing an assembly jig shaped to receive said frame thereon, and having a pair of upstanding studs spaced laterally apart a distance slightly less than the distance between the outer edges of said frame side segments; and inserting the side segments of said frame between said studs, thereby deflecting said frame side segments inwardly, and temporarily retaining said frame side segments in the deflected condition during said screen attaching step.

5. A method as set forth in claim 4, wherein: said studs have base portions; and said frame inserting step comprises:

positioning the outer edge of one of said frame side segments adjacent a base portion of one of said studs; and pressing the other one of said frame side segments generally downwardly against the other one of said studs, thereby camming said frame between said studs.

6. A method as set forth in claim 5, wherein said screen tensing step comprises:

providing a tensing frame having a perimeter larger than the perimeter of said printing frame and means for retaining said screen panel therein;

mounting said screen panel in a uniformly taut condition in said tensing frame; and assembling said tensing frame with taut screen panel therein over said printing frame in the deflected condition.

7. A method as set forth in claim 6, wherein said screen assembling step comprises:

biasing said taut screen panel over the perimeter of said printing frame.

8. A method as set forth in claim 7, wherein said screen assembly step further comprises:

providing sharpened tips at the free ends of said studs; and pressing said taut screen panel against said stud tips thereby puncturing said screen panel to form apertures through which said studs are received to permit abutment between said screen panel and said printing frame.

9. A method as set forth in claim 8, wherein said screen panel attaching step comprises:

adhering said taut screen panel to the end and side segments of said printing frame; and severing said printing frame from said screen panel between the perimeters of said tensing frame and said printing frame.

10. A kit for making screens to print arcuate articles and the like, comprising:

a printing frame having substantially rigid end segments, and resilient, semi-rigid side segments connected therewith to define a plane with a frame perimeter; said frame side segments have outer edges spaced apart a predetermined distance; said frame being adapted to be flexed along said frame side segments in a direction generally transverse to the plane of said frame into an arcuate configuration which mates with the shape of the article to be printed;

a panel of screen material adapted for attachment to said frame and for carrying a pattern thereon;

said frame having first and second functional configurations, said first configuration being substantially flat with medial portions of said side segments being laterally deflected toward each other a predetermined distance for attaching said panel of elastic screen material to said frame, and said second printing configuration being an arcuate configuration wherein said side segments are flexed in a direction generally transverse to the plane of the frame and corresponds with the shape of the article to be printed;

an assembly jig shaped to receive said frame thereon, and having a pair of upstanding stops anchored therein; said stops having interior sides and being spaced apart a distance slightly less than the distance between the outer edges of said frame side segments, and allowing for the deflection of the medial portions of said frame side segments inwardly a predetermined distance when said frame is received on said jig; said jig having printing frame retaining means for retaining said frame thereon with said frame side segments in a deflected configuration;

a tensing frame having a perimeter larger than the perimeter of said printing frame, and means for retaining said screen panel therein in a generally, uniformly taut condition, whereby the kit allows for the attaching of said taut screen panel to said printing frame in the deflected condition to laterally stress said screen panel when released from said assembly jig, forming a pattern on the laterally stressed screen panel with said screen panel in a substantially flat condition; and thereby distortion of said pattern is alleviated when said printing frame is flexed into said arcuate printing configuration;

a rigid screen holder having end plates with detachable connecting means for detachably connecting said printing frame end segments therewith, and being mutually inclined for bending said frame into and maintaining said frame in the desired printing configuration.

11. A kit as set forth in claim 10, wherein:

said screen holder includes a cut-out center which permits said screen to extend unsupported between said frame end segments to facilitate conforming said screen to the articles to be printed.

12. A kit as set forth in claim 11, wherein:

said printing frame retaining means comprises serrations along the interior sides of said stops.

13. A kit for making screens to print arcuate articles and the like, comprising:

a printing frame having substantially rigid end segments, and resilient, semi-rigid side segments connected therewith to define a plane with a frame perimeter; said frame side segments have outer edges spaced apart a predetermined distance; said frame being adapted to be flexed along said frame side segments in a direction generally transverse to the plane of said frame into an arcuate configuration which mates with the shape of the article to be printed;

a panel of screen material adapted for attachment to said frame and for carrying a pattern thereon;

said frame having first and second functional configurations, said first configuration being substantially flat with medial portions of said side segments being laterally deflected toward each other a predetermined distance for attaching said panel of elastic screen material to said frame, and said second printing configuration being an arcuate configuration wherein said side segments are flexed in a direction generally transverse to the plane of the frame and corresponds with the shape of the article to be printed;

an assembly jig shaped to receive said frame thereon, and having a pair of upstanding stops anchored therein; said stops having interior sides and being spaced apart a distance slightly less than the distance between the outer edges of said frame side segments, and allowing for the deflection of the medial portions of said frame side segments inwardly a predetermined distance when said frame is received on said jig; said jig having printing frame retaining means for retaining said frame thereon with said frame side segments in the deflected configuration;

said printing frame retaining means comprising serrations along the interior sides of said stops;

a tensing frame having a perimeter larger than the perimeter of said printing frame, and means for retaining said screen panel therein in a generally, uniformly taut condition, whereby the kit allows for the attaching of said taut screen panel to said printing frame in the deflected condition to laterally stress said screen panel when released from said assembly jig, forming a pattern on the laterally stressed screen panel with said screen panel in a substantially flat condition; and thereby distortion of said pattern is alleviated when said printing frame is flexed into said arcuate printing configuration;

a rigid screen holder having end plates with detachable connecting means for detachably connecting said printing frame end segments therewith, and being mutually inclined for bending and maintaining said frame into the desired printing configuration, said screen holder including a cut-out center which permits said screen to extend unsupported between said frame end segments to facilitate conforming said screen to the articles to be printed;

said jig stops having sharpened free ends which allow for puncturing said screen panel to facilitate screen assembly by said screen panel passing over said stops.

14. A kit as set forth in claim 13, wherein:

said jig includes converging means for adjustably converging said tensing frame therewith and positively retaining the same in an abutting, overlying relationship.

15. A kit as set forth in claim 14, wherein: said screen panel material is elastic.

16. An assembly jig for making printing screens of the type having a frame with a perimeter which includes substantially rigid end segments and resilient, spaced side segments, and a screen panel mounted in the frame; said assembly jig comprising:

a base shaped to receive the printing screen frame thereon;

first and second studs anchored in and upstanding from a medial portion of said base; said studs having interior sides and being substantially rigid and spaced laterally apart a distance slightly less than the spacing between the outer edges of said frame side segments, whereby said frame side segments are deflected inwardly at a medial portion thereof when inserted between said studs;

serrations on the interior sides of said studs for retaining the printing frame between said studs; and said studs having pointed free ends oriented to pierce the screen panel when the screen panel is placed in contact with said studs.

17. An assembly jig as set forth in claim 16, including:

a screen tensing frame having a perimeter larger than the perimeter of said printing frame, and means for retaining said screen panel therein in a generally, uniformly taut condition.

18. An assembly jig as set forth in claim 17, including:

converging means for converging said tensing frame with said jig and retaining the same in abutment during attachment of said printing frame.

19. An assembly jig as set forth in claim 18 wherein:

said converging means comprises at least two threaded fasteners extending through opposite sides of said tensing frame.

* * * * *